US006409526B1

(12) United States Patent
Malone et al.

(10) Patent No.: US 6,409,526 B1
(45) Date of Patent: Jun. 25, 2002

(54) MECHANISM FOR ENGAGING AND DISENGAGING PRINTED CIRCUIT BOARD CONNECTORS

(75) Inventors: Christopher G. Malone, Folsom; Glenn C. Simon, Auburn; Dennis C. Thompson, deceased, late of Roseville, all of CA (US), by Leanna V. Thompson, legal representative

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/678,079

(22) Filed: Oct. 3, 2000

(51) Int. Cl.[7] ..... H01R 13/62
(52) U.S. Cl. ..... 439/160; 439/75
(58) Field of Search ..... 439/160, 74, 75, 439/78, 923

(56) References Cited

U.S. PATENT DOCUMENTS

| | | | | | |
|---|---|---|---|---|---|
| 3,484,129 | A | | 12/1969 | Askren | 294/15 |
| 3,617,083 | A | | 11/1971 | Koppensteiner | 294/15 |
| 3,662,321 | A | * | 5/1972 | Bury | 439/363 |
| 4,223,934 | A | | 9/1980 | Cauceglia et al. | 294/15 |
| 4,858,309 | A | | 8/1989 | Korsunsky et al. | 29/764 |
| 4,909,746 | A | * | 3/1990 | Scholz | 439/82 |
| 4,929,185 | A | * | 5/1990 | Wong et al. | 439/74 |
| 4,998,887 | A | * | 3/1991 | Kaufman et al. | 439/78 |
| 5,137,462 | A | * | 8/1992 | Casey et al. | 439/74 |
| 5,269,692 | A | * | 12/1993 | Takahashi | 439/74 |
| 5,414,594 | A | | 5/1995 | Hristake | 361/755 |
| 5,575,686 | A | * | 11/1996 | Noschese | 439/620 |
| 5,655,914 | A | * | 8/1997 | McCartin et al. | 439/78 |
| 5,785,449 | A | | 7/1998 | DiBene | 403/343 |
| 6,033,254 | A | | 3/2000 | Neal et al. | 439/377 |
| 6,039,581 | A | * | 3/2000 | DiMarco | 439/74 |

* cited by examiner

*Primary Examiner*—Khiem Nguyen
*Assistant Examiner*—Hae Moon Hyeon

(57) ABSTRACT

A mechanism for use in insertion and extraction of a first printed circuit board (PCB) to and from a second PCB so as to engage and disengage an electrical connector of the first PCB to and from a corresponding electrical connector of the second PCB. The insertion and extraction mechanism includes a stiffener bar and a mounting block. The stiffener bar is affixed to the first PCB immediately adjacent to the electrical connector for stiffening the first PCB in the vicinity of the electrical connector. The mounting block is affixed to the second PCB immediately adjacent to the corresponding electrical connector. A threaded fastener is carried by the stiffener bar and is engageable with the mounting block. Rotation of the fastener in a first direction causes the first PCB to be inserted to the second PCB which causes the electrical connector to be engaged with the corresponding electrical connector. Rotation of the fastener in a second direction causes the first PCB to be extracted from the second PCB which causes the electrical connector to be disengaged from the corresponding electrical connector. An alignment pin of the stiffener bar is engageable with an alignment opening in the mounting block to insure that the electrical connector and the corresponding electrical connector are properly aligned during insertion and extraction of the first PCB to and from the second PCB.

19 Claims, 5 Drawing Sheets

MECHANISM FOR ENGAGING AND DISENGAGING PRINTED CIRCUIT BOARD CONNECTORS

TECHNICAL FIELD

This invention relates generally to printed circuit boards (PCB's). In particular, the present invention is a mechanism for inserting and extracting printed circuit boards into and out of a peripheral component interconnect (PCI) computer system housing. The mechanism provides a mechanical advantage to supply the necessary forces to engage and disengage male and female connector pairs of a pair of PCB's mounted within the PCI computer system housing.

BACKGROUND OF THE INVENTION

One type of computer system housing employs a PCB input/output (I/O) connection system known as the peripheral component interconnect (PCI) system. The popularity of the PCI system has grown to a point where it is the preferred I/O connection system for larger server computers as well as workstation computers. The PCI system allows one or more microprocessors (i.e., PCB's) to be interconnected with attached external devices.

The PCI system includes a computer system housing defined by a plurality of walls. At least one of these walls is removable to provide access to an interior region of the housing to allow PCB's to be inserted into and removed from the housing. The PCB's are releasably connectable to a central processing unit of the computer system through a PCB known as a "mother board", or a "backplane board", as it is vertically mounted as a back wall of the computer system housing. PCB's, typically known as "daughter boards" are electrically connected (i.e., plugged) via mating pairs of electrical connectors mounted to the daughter boards and the mother board. These electrical connectors typically include a plurality of socket terminals (i.e., female connector) that are attached to the daughter boards which are plug compatible with pin terminals (i.e., male connector) attached to the mother board to allow data and/or power to be transmitted between the joined components.

With this type of computer system, it is considered standard procedure to either correct faulty components or to incorporate changes (i.e., upgrades) in an existing system by removing the faulty PCB's (i.e., daughter boards), or the PCB's requiring upgrades, and substituting new PCB's in their place. To replace faulty or obsolete PCB's with new PCB's requires that the faulty/obsolete PCB's be extracted from the mother board (i.e., vertical PCB) by un-mating of the electrical connectors coupling these components. By the same token, inserting new PCB's into the computer system requires mating of the electrical connectors of the PCB's and mother board.

Although the coupling of the pin terminals (i.e., male component) with the socket terminals forms a reliable electrical connection, there are some drawbacks in the use of male/female PCB electrical interconnects. For example, because of the necessity to create a reliable electrical connection between these mating male and female components of the electrical connector, these PCB electrical connectors often require large mechanical forces in order to engage and disengage these male and female connector components. Due to these high magnitude engagement/disengagement forces during the PCB extraction/insertion process and the confined working environment of computer systems, damage to the PCB's (both mother and daughter boards), the male and female connector components and/or electrical components on the PCB's is of great concern. For example, these large engagement/disengagement forces can cause flexing of the PCB's during the extraction/insertion process that could cause bent pin terminals on the mating electrical connectors or damage to devices located on the PCB in the vicinity of the mating connectors. Pin damage renders the electrical connector useless, and repair of the electrical connector (if possible) is time consuming and costly. As such, otherwise operational PCB's having connectors with damaged pin terminals are often discarded simply because of the damaged pins. Moreover, damaged electrical connectors can result in a loss of electrical contact between mated male/female electrical components that can cause start-up problems, intermittent operation or total inoperability, thereby causing the overall quality of the computer system to be diminished.

To prevent damage, technicians often employ a pair of lever mechanisms that provide a mechanical advantage to supply the necessary mechanical forces to extract and insert PCB's. Although, these lever mechanisms provide the necessary mechanical forces to extract and insert PCB's, these forces are typically applied at the rear of the PCB to be removed/inserted and far removed from the mating electrical connector components. As such, the lever mechanisms can also cause PCB flex that could cause damage to PCB components or the electrical connectors. Moreover, this pair of lever mechanisms can apply these mechanical extraction/insertion forces to the PCB in an uneven manner potentially further damage to the electrical connectors and PCB components.

There is a need for a mechanism for extracting and inserting PCB's from and to a PCB mother board. In particular, there is a need for an extraction/insertion mechanism that provides a mechanical advantage by supplying the mechanical forces necessary to disengage (i.e., un-mate) and engage (i.e., mate) male and female electrical connectors mounted to the PCB's. The extraction/insertion mechanism should direct these mechanical forces at the mating female/male electrical connector components to provide the mechanical advantage where it is needed most. In addition, the extraction/insertion mechanism should substantially prevent PCB flex in the vicinity of the mating female/male electrical connector components, so as to prevent PCB damage, electrical connector damage (i.e., pin terminal damage) and/or damage to electrical components mounted to the PCB during the extraction/insertion process (i.e., mating/un-mating process). This damage could otherwise render the electrical connectors, the PCB and electronic components useless, or diminish the overall quality of the computer system. Moreover, the extraction/insertion mechanism should reliably provide these features so as to preclude time consuming and costly repairs of the electrical connectors and the PCB's and electronic components mounted to the PCB's. Furthermore, the extraction/insertion mechanism should be readily removable from and installable to the PCB's. Lastly, the extraction/insertion mechanism should be relatively easy and inexpensive to manufacture.

SUMMARY OF THE INVENTION

The present invention is a mechanism for use in insertion and extraction of a first printed circuit board (PCB) to and from a second PCB so as to engage and disengage an electrical connector of the first PCB to and from a corresponding electrical connector of the second PCB. The insertion and extraction mechanism includes a first member affixed to the first PCB immediately adjacent to the electrical connector. The first member stiffens the first PCB in the vicinity of the electrical connector. A second member is affixed to the second PCB immediately adjacent to the corresponding electrical connector. A movable fastener is engageable with the first and second members. Movement of the fastener in a first direction causes the first PCB to be inserted to the second PCB which causes the electrical connector to be engaged with the corresponding electrical connector. Movement of the fastener in a second direction causes the first PCB to be extracted from the second PCB which causes the electrical connector to be disengaged from the corresponding electrical connector.

In one aspect of the present invention, the first member is a T-shaped stiffener bar that includes a stiffening portion and an engagement portion, the second member is a mounting block and the fastener is a threaded fastener. The stiffening portion is immediately adjacent to and extends along the electrical connector. The threaded fastener is carried by the engagement portion and engages a threaded opening in the mounting block to insert and extract the first PCB to and from the second PCB thereby engaging and disengaging the electrical connector to and from the corresponding electrical connector. In another aspect of the present invention, the insertion and extraction mechanism includes an alignment pin that is mounted to and extends outwardly from the engagement portion of the stiffener bar. The alignment pin engages an alignment opening in the mounting block to insure that the electrical connector and the corresponding electrical connector are properly aligned with one another upon engagement and disengagement during insertion and extraction of the first PCB to and from the second PCB. In a further aspect of the present invention, the electrical connector is a male connector and the corresponding electrical connector is a corresponding female connector.

In this insertion and extraction mechanism of the present invention, the threaded fastener provides a mechanical advantage by supplying the mechanical forces necessary to disengage (i.e., un-mate) and engage (i.e., mate) the male and female electrical connectors mounted to the first and second PCB's. The insertion and extraction mechanism directs these mechanical forces at the mating female/male electrical connector components to provide the mechanical advantage where it is needed most. In addition, the stiffening portion of the stiffener bar of the insertion and extraction mechanism substantially prevents flex of the first PCB in the vicinity of the mating/un-mating female/male electrical connector components, so as to prevent PCB damage, electrical connector damage (i.e., pin terminal damage) and/or damage to electrical components mounted to the PCB during the extraction/insertion process (i.e., mating/un-mating process). This damage could otherwise render the electrical connectors, the PCB and electronic components useless, or diminish the overall quality of the computer system. Moreover, the insertion and extraction mechanism reliably provides these features so as to preclude time consuming and costly repairs of the electrical connectors and the PCB's and electronic components mounted to the PCB's. Furthermore, the stiffener bar and mounting block of the insertion and extraction mechanism are readily removable from and installable to the PCB's. Lastly, the components of the extraction/insertion mechanism are relatively easy and inexpensive to manufacture.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
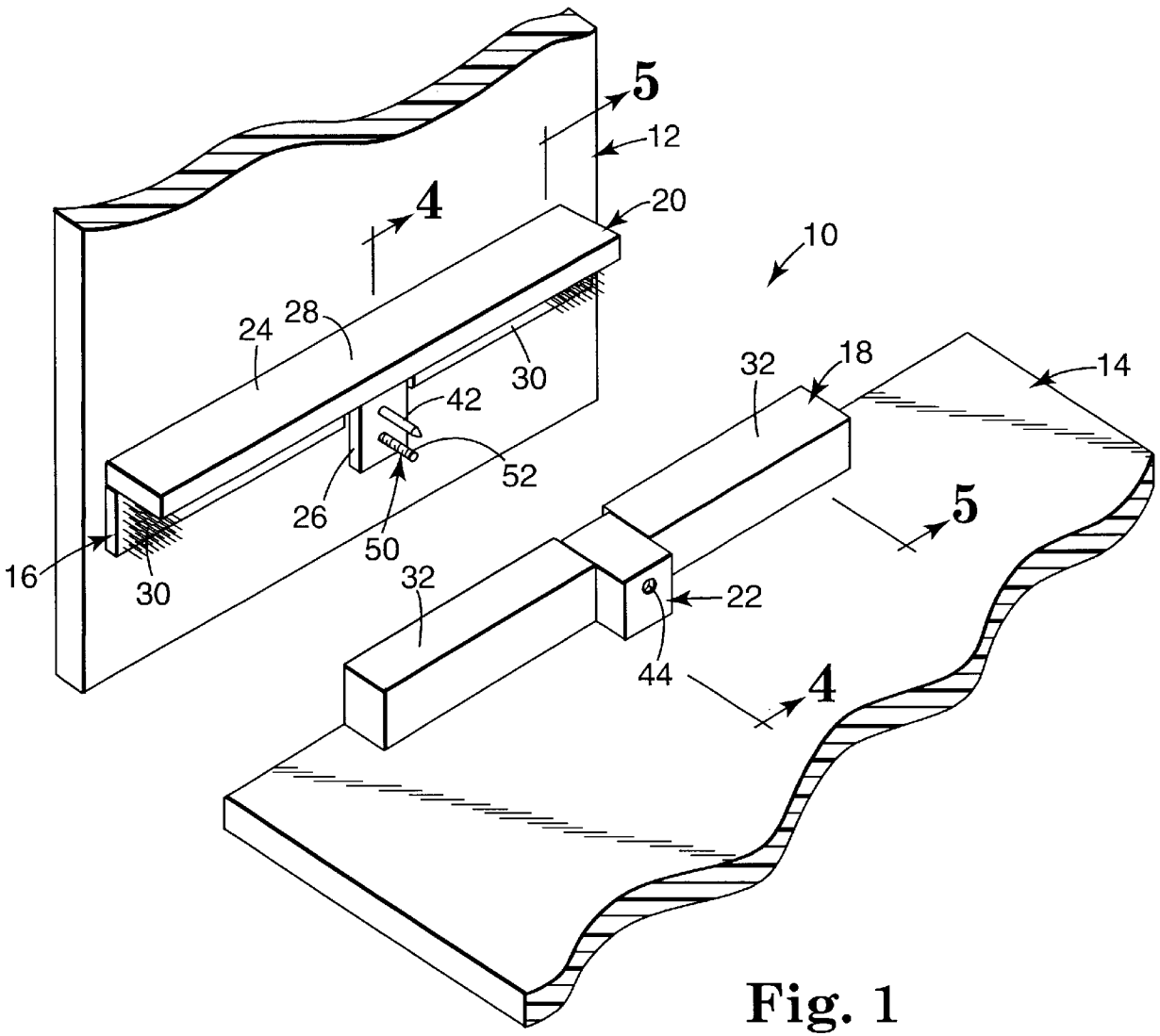
FIG. 1 is a partial perspective view of a stiffener bar and mounting block of a PCB insertion and extraction mechanism in accordance with the present invention.

A mechanism 10 for use in insertion and extraction of a first printed circuit board (PCB) 12 to and from a second PCB 14 so as to engage (i.e., mate) and disengage (i.e., un-mate) an electrical connector 16 of the first PCB 12 to and from a corresponding electrical connector 18 of the second PCB 14 in accordance with the present invention is generally illustrated in FIG. 1. The insertion and extraction mechanism 10 includes a first member or T-shaped stiffener bar 20 which is affixed to the first PCB 12 immediately adjacent to the electrical connector 16, and a second member or rectangular mounting block 22 which is affixed to the second PCB 14 immediately adjacent to the corresponding electrical connector 18. In one embodiment, the first PCB 12 is a vertically oriented system motherboard, and the second PCB 14 is a horizontally oriented system daughter board.

Figure 2:
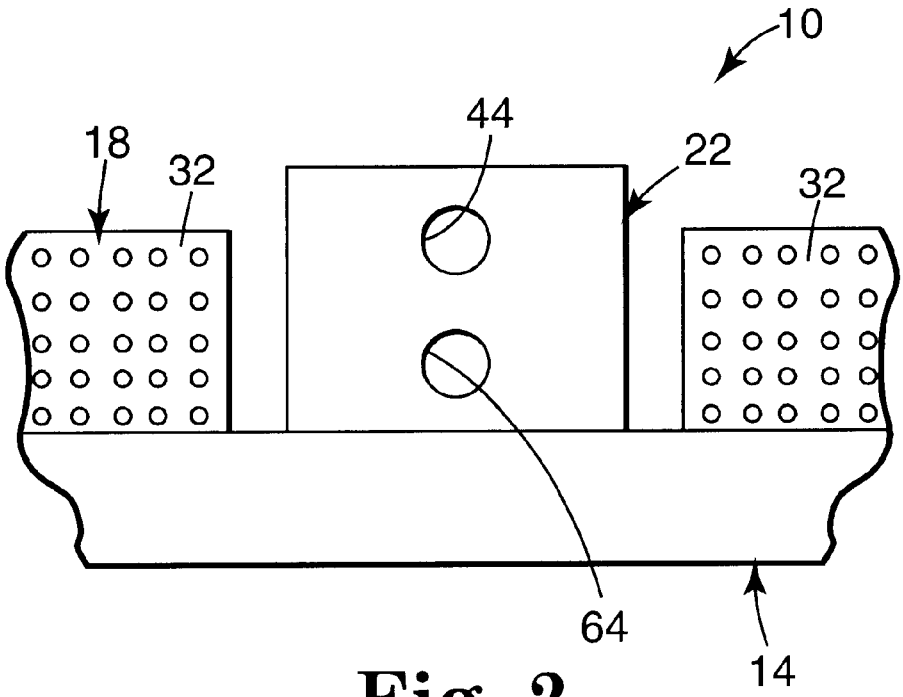
FIG. 2 is front elevational view of the mounting block shown in FIG. 1.

As seen in FIG. 1, the stiffener bar 20 includes a rectangular shaped stiffening portion 24 that is immediately adjacent to and extends across the first PCB 12 and along the electrical connector 16 of the first PCB 12. The stiffening portion 24 acts to stiffen the first PCB 12 in the vicinity of the electrical connector 16. The stiffener bar 20 further includes a rectangular shaped engagement portion 26 that extends outwardly (i.e., downwardly in FIG. 1) from a median region 28 (see FIG. 1) of the stiffening portion 24. As can be seen in FIG. 1, the electrical connector 16 is defined by a pair of spaced, male multi-pin connectors 30. As can be seen in FIGS. 1 and 2, the corresponding electrical connector 18 is defined by a pair of spaced, corresponding female multi-socket connectors 32. The mounting block 22 is mounted (i.e., positioned) on the second PCB 14 so as to extend between the pair of spaced, corresponding female multi-socket connectors 32. The stiffener bar 20 is mounted to the first PCB 12 such that the engagement portion 26 is positioned on the first PCB 12 so as to extend between the pair of spaced, male multi-pin connectors 30, while the stiffening portion 24 extends across the top of the multi-pin connectors 30. In this way, the stiffening portion 24 of the stiffener bar 20 stiffens the otherwise flexible first PCB 12 in the vicinity of the male connectors 30. This is exactly where the first PCB 12 requires stiffening since the first PCB 12 is most prone to flexing in this region during insertion and extraction of a first printed circuit board (PCB) 12 to and from a second PCB 14 so as to engage (i.e., mate) and disengage (i.e., un-mate) the electrical connector 16 (i.e., multi-pin connectors 30) of the first PCB 12 to and from the corresponding electrical connector 18 (i.e., multi-socket connectors 32) of the second PCB 14.

Figure 4:
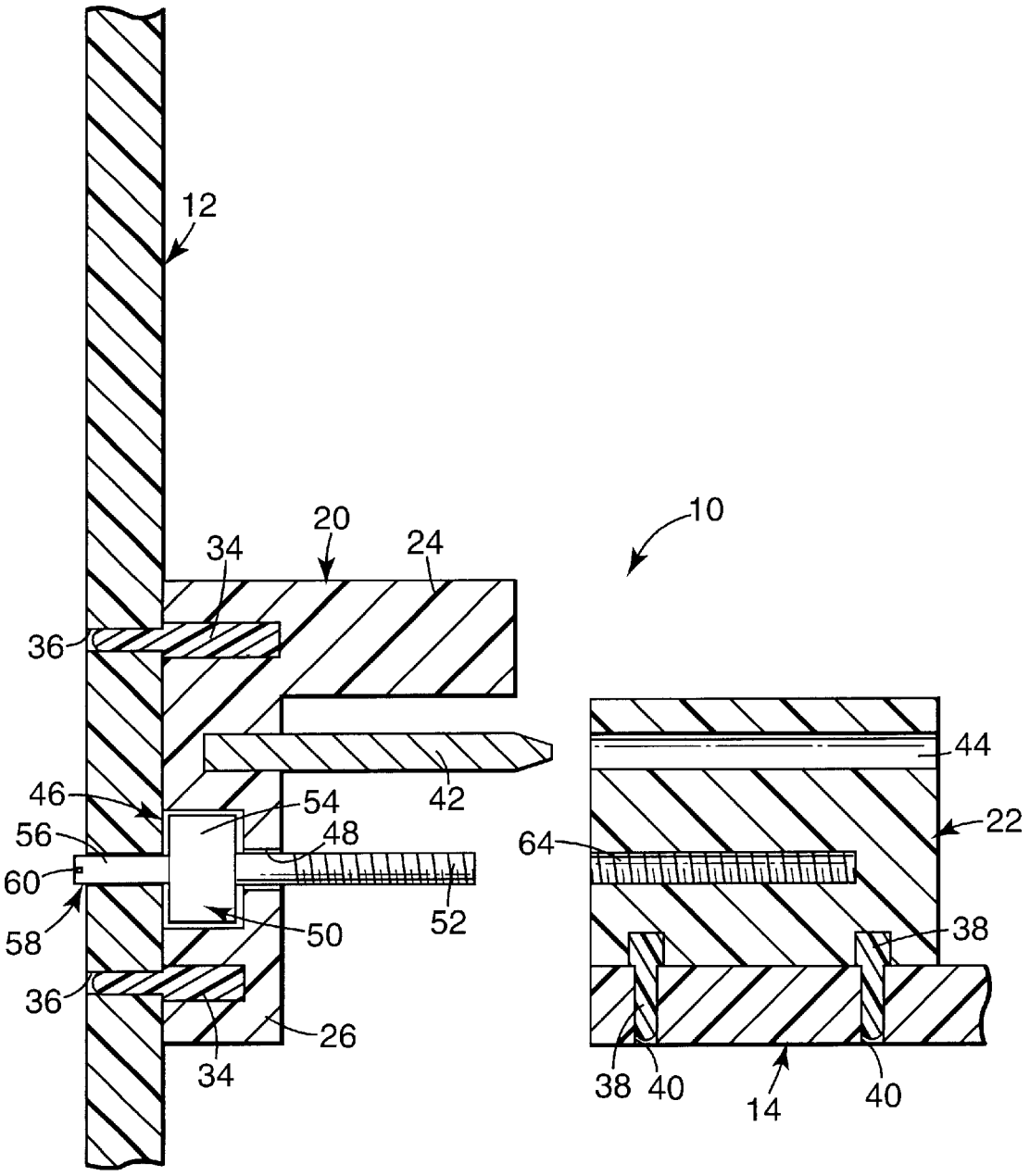
FIG. 4 is a partial sectional view taken along line 4—4 in FIG. 1 showing the stiffener bar and mounting block of the PCB insertion and extraction mechanism in a disengaged (i.e., un-mated) state.

As can be seen best in FIG. 4, the stiffener bar 20 includes a plurality of mounting fasteners 34 that engage openings 36 in the first PCB 12 to secure the stiffener bar 20 to the first PCB 12 in a readily removable fashion. Likewise, the mounting block 22 includes a plurality of mounting fasteners 38 that engage openings 40 in the second PCB 14 to secure the mounting block 22 to the second PCB 14 in a readily removable fashion. Although, only two mounting fasteners 34, 38 are shown for each of the stiffener bar 20 and the mounting block 22, there are in actuality more than just two mounting fasteners 34, 38 extending between the stiffener bar 20 and the first PCB 12 and between the mounting block 22 and the second PCB 14 to secure these components together.

As can be seen best in FIGS. 1 and 4, the engagement portion 26 of the stiffener bar 20 of the insertion and extraction mechanism 10 includes an outwardly extending guide element or alignment pin 42 mounted thereto. The alignment pin 42 is configured to engage an alignment through opening 44 of the mounting block 22. The alignment opening 44 is sized to closely receive the alignment pin 42 of the stiffener bar 20 to insure that the multi-pin connectors 30 and the corresponding multi-socket connectors 32 are properly aligned with one another upon engagement and disengagement during insertion and extraction of the first PCB 12 to and from the second PCB 14.

Figure 3:
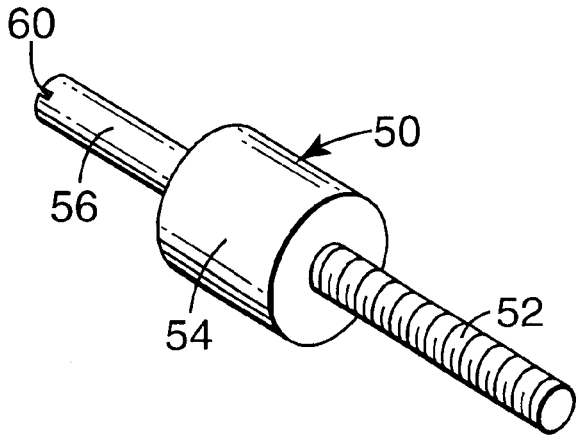
FIG. 3 is a perspective view of a threaded fastener of the PCB insertion and extraction mechanism in accordance with the present invention.

As can be seen best in FIG. 4, the engagement portion 26 of the stiffener bar 20 of the insertion and extraction mechanism 10 further defines a cylindrical recess 46 and a through opening 48 which is concentric with the cylindrical recess 46 and is parallel to the alignment pin 42. The cylindrical recess 46 and the through opening 48 are sized to freely receive a rotatable threaded fastener 50, such that the threaded fastener is readily and freely rotatable relative to the engagement portion 26 of the stiffener bar 20. As seen best in FIG. 3, the threaded fastener 50 includes a threaded end portion 52, a intermediate cylindrical retaining portion 54, and a proximal drive portion 56.

As seen best in FIG. 4, the threaded portion 52 is freely rotatably received within the through opening 48 of the engagement portion 26. The cylindrical retaining portion 54 has a diameter greater than a diameter of the threaded portion 52. The cylindrical retaining portion 54 is freely rotatably received within the cylindrical recess 46 of the engagement portion 26. The drive portion 56 extends through an opening 58 in the first PCB 12 so as to be freely rotatable relative thereto. The drive portion 56 of the threaded fastener 50 includes a slot 60 that can be engaged by a screw driver (not shown) to allow a user to impart rotational movement to the threaded fastener 50. As can be seen in FIG. 4, the cylindrical recess 46 of the engagement portion 26 of the stiffener bar 20 and the first PCB 12 act to surround the cylindrical retaining portion 54 of the threaded fastener 50 to retain the threaded fastener 50 on the first PCB 12.

As can be seen best in FIGS. 2 and 4, the mounting block 22 includes a threaded opening 64 that is parallel with the alignment opening 44. The threaded opening 64 is configured to threadably receive the threaded end portion 52 of the threaded fastener 50, such that rotatable movement of the threaded fastener 50 in a first direction (i.e., clockwise) causes the mounting block 22 to be drawn towards the engagement portion 26 of the stiffener bar 20 which causes the second PCB 14 to be inserted to the first PCB 12, which also causes the multi-pin connectors 30 to be engaged with the corresponding multi-socket connectors 32. Rotatable movement of the threaded fastener in a second opposite direction (i.e., counter-clockwise) causes the mounting block 22 to be pushed away from the engagement portion 26 of the stiffener bar 20 which causes the second PCB 14 to be extracted from the first PCB 12 which also causes the multi-pin connectors 30 to be disengaged from the corresponding multi-socket connectors 32.

In one preferred embodiment, the threaded fastener is made of metal, such as steel, and the stiffener bar 20, mounting block 22 and alignment pin 42 are manufactured of metal, such as aluminum.

Figure 5:
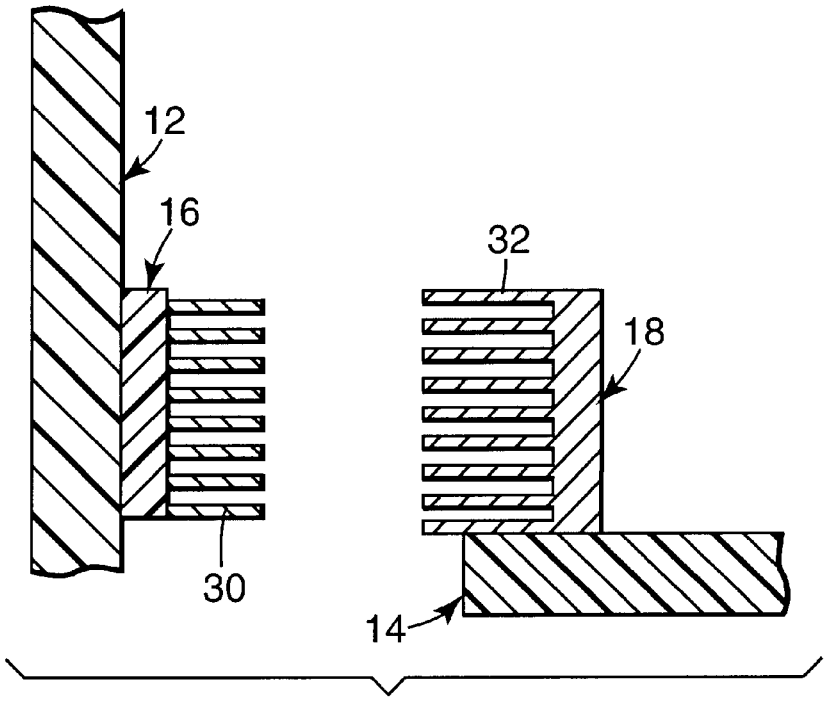
FIG. 5 is a partial sectional view taken along lie 5—5 in FIG. 1 illustrating a male electrical connector and a female electrical connector in a disengaged (i.e., un-mated) state.
Figure 7:
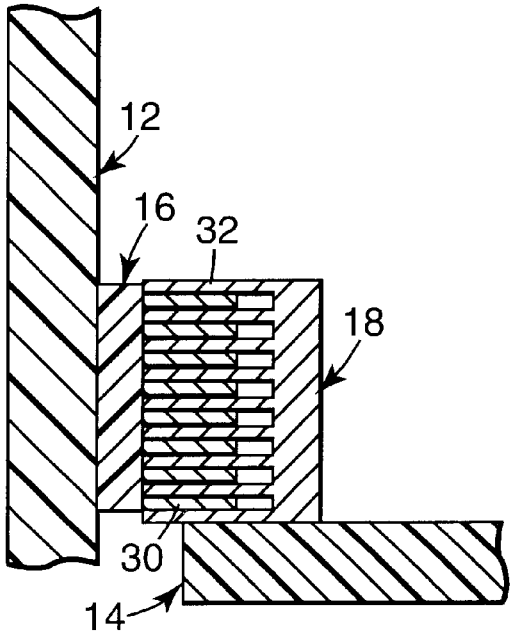
FIG. 7 is a partial sectional view similar to FIG. 5 illustrating the male electrical connector and a female electrical connector in an engaged (i.e., mated) state.
Figure 6:
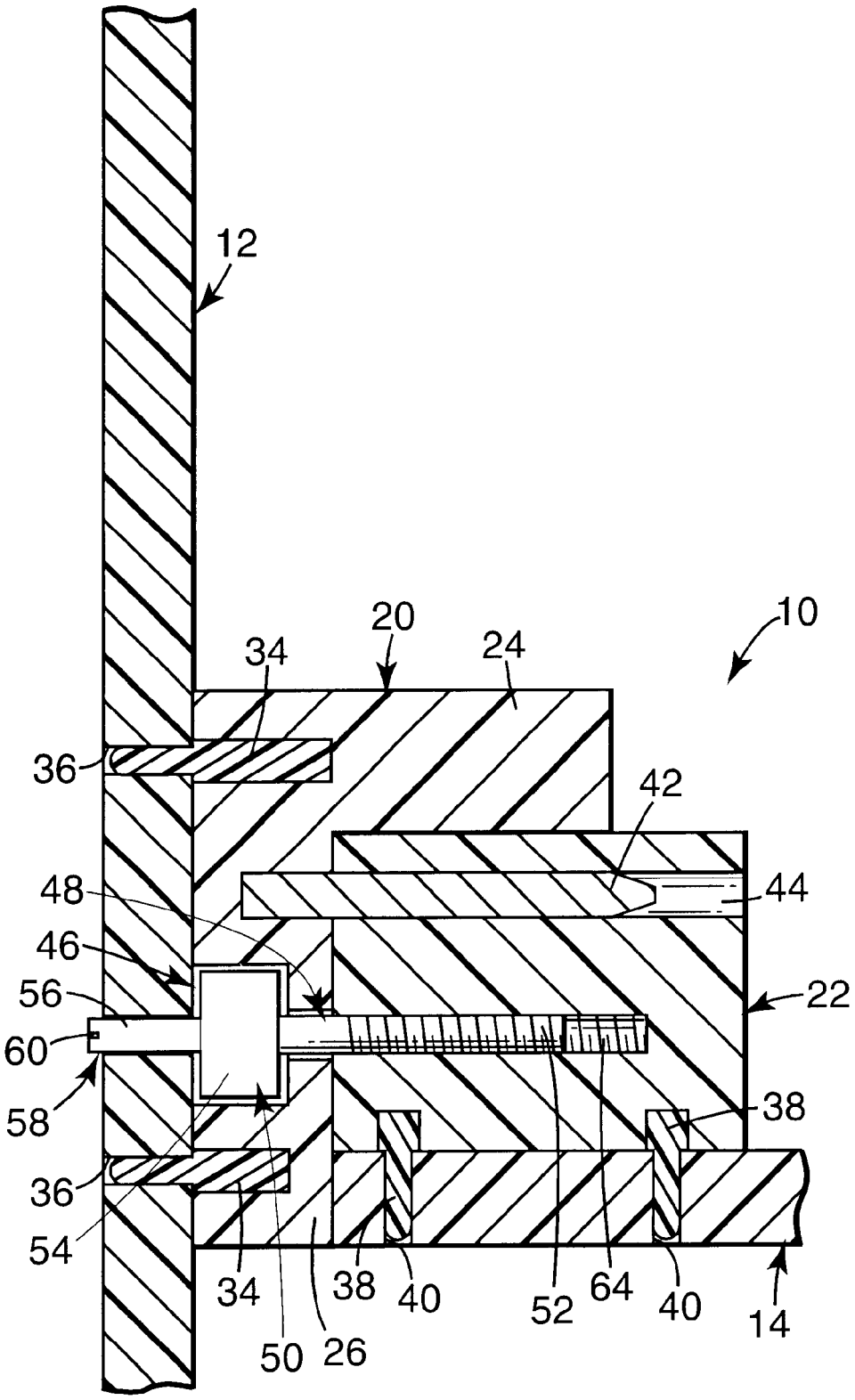
FIG. 6 is a partial sectional view similar to FIG. 4 showing the stiffener bar and mounting block of the PCB insertion and extraction mechanism in an engaged (i.e., mated) state.

As seen in FIG. 4, to insert the second PCB 14 to the first PCB 12, a user starts by aligning the alignment opening 44 of the mounting block 22 with the alignment pin of the stiffener bar 20. In this disengaged state, the multi-pin connectors 30 and the multi-socket connectors 32 are oriented as shown in FIG. 5. Next, the threaded portion 52 of the threaded fastener 50, carried by the stiffener bar 20, is engaged with the threaded opening 64 of the mounting block 22, whereupon rotational movement of the threaded fastener 50 in the first direction (i.e., clockwise) causes the mounting block 22 to be drawn towards the engagement portion 26 of the stiffener bar 20 which causes the second PCB 14 to be inserted to the first PCB 12, which also causes the multi-pin connectors 30 to be engaged with the corresponding multi-socket connectors 32. In this engaged state illustrated in FIGS. 6 and 7, the engagement portion 26 of the stiffener bar 20 is engaged with the mounting block 22, the second PCB 14 is fully inserted to the first PCB 12, and the multi-pin connectors 30 are fully engaged with the corresponding multi-socket connectors 32, such that the second PCB 14 forms substantially a 90° angle with respect to the first PCB 12.

To extract the second PCB 14 from the first PCB 12, a user merely rotates the threaded fastener 50 in the second opposite direction (i.e., counter-clockwise), which causes the mounting block 22 to be pushed away from the engagement portion 26 of the stiffener bar 20, which causes the second PCB 14 to be extracted from the first PCB 12, and which also causes the multi-pin connectors 30 to be disengaged from the corresponding multi-socket connectors 32.

In this insertion and extraction mechanism 10 of the present invention, the threaded fastener 50 provides a mechanical advantage by supplying the mechanical forces necessary to disengage (i.e., un-mate) and engage (i.e., mate) the male and female electrical connectors 30, 32 mounted to the first and second PCB's 12, 14. The insertion and extraction mechanism 10 directs these mechanical forces at the mating female/male electrical connector components 30, 32 to provide the mechanical advantage where it is needed most (i.e., where the connection is most secure).

In addition, the stiffening portion 24 of the stiffener bar 20 of the insertion and extraction mechanism 10 substantially prevents flex of the first PCB 12 in the vicinity of the mating/un-mating female/male electrical connector components 30, 32, so as to prevent PCB damage, electrical connector damage (i.e., pin terminal damage) and/or damage to electrical components mounted to the PCB during the extraction/insertion process (i.e., mating/un-mating process). This damage could otherwise render the electrical connectors, the PCB and electronic components useless, or diminish the overall quality of the computer system. Moreover, the insertion and extraction mechanism 10 reliably provides these features so as to preclude time consuming and costly repairs of the electrical connectors and the PCB's and electronic components mounted to the PCB's. Furthermore, the stiffener bar 20 and the mounting block 22 of the insertion and extraction mechanism 10 are readily removable from and installable to the PCB's via the mounting fasteners 34, 38. Lastly, the components of the extraction/insertion mechanism 10 are relatively easy and inexpensive to manufacture.

Although the present invention has been described with reference to preferred embodiments, workers skilled in the art will recognize that changes may be made in form and detail without departing from the spirit and scope of the invention.

What is claimed is:

1. A mechanism for use in insertion and extraction of an electrical connector of a first printed circuit board (PCB) to and from a corresponding electrical connector of a second PCB, the insertion and extraction mechanism comprising:

a first member affixed to the first PCB immediately adjacent to the electrical connector, wherein the first member stiffens the first PCB in the vicinity of the electrical connector;

a second member affixed to the second PCB immediately adjacent to the corresponding electrical connector;

a movable fastener engageable with the first and second members, wherein movement of the fastener in a first direction causes the electrical connector of the first PCB to be inserted to the corresponding electrical connector of the second PCB, and wherein movement of the fastener in a second direction causes the electrical connector of the first PCB to be extracted from the corresponding electrical connector of the second PCB; and a guide element engageable between only the first and second members so as to be free of any engagement with the electrical connector and the corresponding electrical connector, the guide element insuring that the electrical connector and the corresponding electrical connector are properly aligned with one another during insertion and extraction of the electrical connector of the first PCB to and from the corresponding electrical connector of the second PCB.

2. The insertion and extraction mechanism of claim 1 wherein the guide element is an alignment pin that is mounted to and extends outwardly from the first member.

3. The insertion and extraction mechanism of claim 2 wherein the second member defines an alignment opening sized to closely receive the alignment pin of the first member to insure that the electrical connector and the corresponding electrical connector are properly aligned with one another during insertion and extraction of the electrical connector of the first PCB to and from the corresponding electrical connector of the second PCB.

4. The insertion and extraction mechanism of claim 1 wherein the first member is a stiffener bar and wherein the stiffener bar includes:

a stiffening portion that is immediately adjacent to and extends along the electrical connector of the first PCB, the stiffening portion stiffening the first PCB in the vicinity of the electrical connector; and an engagement portion engageable with the second member when the electrical connector of the first PCB is fully inserted to the corresponding electrical connector of the second PCB.

5. The insertion and extraction mechanism of claim 4 wherein the movable fastener is carried by and movable relative to the engagement portion of the stiffener bar.

6. The insertion and extraction mechanism of claim 5 wherein the movable fastener is a threaded fastener that is rotatably movable in the first direction and in the second direction which is opposite to the first direction.

7. The insertion and extraction mechanism of claim 5 wherein the second member is a mounting block that defines a threaded opening for receiving the threaded fastener, wherein rotatable movement of the threaded fastener in the first direction causes the electrical connector of the first PCB to be inserted to the corresponding electrical connector of the second PCB, and wherein movement of the threaded fastener in the second direction causes the electrical connector of the first PCB to be extracted from the corresponding electrical connector of the second PCB.

8. The insertion and extraction mechanism of claim 7 wherein the engagement portion of the stiffener bar defines a cylindrical recess and a through opening, and wherein the threaded fastener includes:

a threaded portion freely received within the through opening;

a cylindrical retaining portion having a diameter greater than a diameter of the threaded portion, with the cylindrical retaining portion being freely received within the cylindrical recess; and a drive portion through which rotational movement is imparted to the threaded fastener.

9. The insertion and extraction mechanism of claim 8 wherein the drive portion freely extends through an opening in the first PCB to allow a user to impart rotational movement to the threaded fastener.

10. The insertion and extraction mechanism of claim 9 wherein the first PCB, the cylindrical recess of the engagement portion of the stiffener bar and the cylindrical retaining portion of the threaded fastener act together to retain the threaded fastener on the first PCB.

11. The insertion and extraction mechanism of claim 7, and further including:

a guide element engageable between the stiffener bar and the mounting block, the guide element insuring that the electrical connector and the corresponding electrical connector are properly aligned with one another during insertion and extraction of the electrical connector of the first PCB to and from the corresponding electrical connector of the second PCB.

12. The insertion and extraction mechanism of claim 11 wherein the guide element is an alignment pin that is mounted to and extends outwardly from the engagement portion of the stiffener bar.

13. The insertion and extraction mechanism of claim 12 wherein the mounting block defines an alignment opening sized to closely receive the alignment pin of the stiffener bar to insure that the electrical connector and the corresponding electrical connector are properly aligned with one another during insertion and extraction of the electrical connector of the first PCB to and from the corresponding electrical connector of the second PCB.

14. The insertion and extraction mechanism of claim 7 wherein the electrical connector is a pair of spaced electrical connectors, and wherein the corresponding electrical connector is a pair of spaced corresponding electrical connectors.

15. The insertion and extraction mechanism of claim 14 wherein the stiffener bar is substantially T-shaped such that the engagement portion extends outwardly from a median of the stiffening portion, and wherein the engagement portion is positioned on the first PCB so as to extend between the pair of spaced electrical connectors.

16. The insertion and extraction mechanism of claim 15 wherein the mounting block is positioned on the second PCB so as to extend between the pair of spaced corresponding electrical connectors.

17. The insertion and extraction mechanism of claim 14 wherein the pair of spaced electrical connectors are a pair of spaced multi-pin electrical connectors, and wherein the pair of spaced corresponding electrical connectors are a pair of spaced corresponding multi-socket electrical connectors.

18. The insertion and extraction mechanism of claim 1 wherein when the electrical connector of the first PCB is fully inserted to the corresponding electrical connector of the second PCB, the second PCB forms substantially a 90° angle with respect to the first PCB.

19. The insertion and extraction mechanism of claim 1 wherein the first PCB is a vertically oriented system motherboard, and wherein the second PCB is a horizontally oriented system daughter board.

* * * * *

UNITED STATES PATENT AND TRADEMARK OFFICE

CERTIFICATE OF CORRECTION

PATENT NO. : 6,409,526 B1
DATED : June 25, 2002
INVENTOR(S) : Malone et al.

It is certified that error appears in the above-identified patent and that said Letters Patent is hereby corrected as shown below:

Column 8,
Line 19, delete “claim 5” and insert therefor -- claim 6 --

Signed and Sealed this

Twenty-seventh Day of May, 2003

JAMES E. ROGAN
*Director of the United States Patent and Trademark Office*